US006843445B2

(12) United States Patent
Högberg et al.

(10) Patent No.: US 6,843,445 B2
(45) Date of Patent: Jan. 18, 2005

(54) REEL STAND

(75) Inventors: Hans Högberg, Åmål (SE); Stefan Bäck, Säffle (SE)

(73) Assignee: Mectec Systems Amal Aktiebolag, Amal (SE)

( * ) Notice: Subject to any disclaimer, the term of this patent is extended or adjusted under 35 U.S.C. 154(b) by 83 days.

(21) Appl. No.: 10/257,376

(22) PCT Filed: May 8, 2001

(86) PCT No.: PCT/SE01/00990

§ 371 (c)(1),
(2), (4) Date: Oct. 17, 2002

(87) PCT Pub. No.: WO01/85587

PCT Pub. Date: Nov. 15, 2001

(65) Prior Publication Data

US 2003/0146338 A1 Aug. 7, 2003

(30) Foreign Application Priority Data

May 12, 2000 (SE) ..... 0017574

(51) Int. Cl.[7] ..... B65H 19/00
(52) U.S. Cl. ..... 242/559.2
(58) Field of Search ..... 242/559.2, 533.4, 242/555.5

(56) References Cited

U.S. PATENT DOCUMENTS 5,320,296 A 6/1994 Ozcariz et al.
5,755,395 A 5/1998 Gnan
6,007,017 A 12/1999 Vorwerk

FOREIGN PATENT DOCUMENTS

SE 458 523 4/1989
WO WO 99/46518 * 9/1999

* cited by examiner

*Primary Examiner*—John Q. Nguyen
(74) *Attorney, Agent, or Firm*—Arent Fox PLLC

(57) ABSTRACT

The invention relates to a roll stand (1) for a continuous unrolling of several rolls (8, 8') of reeled, web-like material, which are unrolled consecutively after each other in the roll stand, and which rolls are arranged to be changed by roll changing from an almost depleted roll (8') to a new, full roll (8) in said roll stand, which roll stand comprises a machine stand (2) with two gable sides (3, 4), which are arranged aloof from each other, a horizontally arranged hub girder (9) which is rotatably journalled at the gable sides and around which hub girder the rolls are arranged to be pivoted between an inlet side (6), to which new, full rolls (8) are delivered, and an outlet side (7) from which the web-like material is unrolled, at least two roll holders (10, 10') which are arranged at the hub girder for handling of each roll and which roll holders each comprises two roll holding arms (11) which are mounted linearly displaceable laterally along one or several, axially along the hub girder and rigidity mounted tracks (12) and of which roll holding arms each is provided with a gripper (13) for seizure of a roll. According to the invention the roll stand also comprises a positioning arrangement (20) for an adjustment of the position of each roll holder (10, 10') laterally along the hub girder (9) and for a mutual adjustment of each of the roll holding arms in each such roll holder after the width of the current roll in the roll holder, an adjustment device (21) at each roll holding arm for releasing of the grippers from a depleted roll and then for re-gripping of a new full roll in connection with roll changing and for a lateral precision adjustment of the position of one roll in relation to another roll and/or for a positioning of the material web to a desired web direction during the present unrolling.

12 Claims, 4 Drawing Sheets

REEL STAND

TECHNICAL FIELD

The present invention relates to a roll stand for a continuous unrolling of several rolls of reeled, web-like material, which are unrolled consecutively after each other in the roll stand, and which rolls are arranged to be changed by roll changing from an almost depleted roll to a new, full roll in said roll stand, which roll stand comprises a machine stand with two gable sides, which are arranged aloof from each other, a horizontally arranged hub girder which is rotatably journalled at the gable sides and around which hub girder the rolls are arranged to be pivoted between an inlet side, to which new, full rolls are delivered, and an outlet side from which the web-like material is unrolled, at least two roll holders which are arranged at the hub girder for handling of each roll and which roll holders each comprises two roll holding arms which are mounted linearly displaceable laterally along one or several, axially along the hub girder and rigidly mounted tracks and of which roll holding arms each is provided with a gripper for seizure of a roll.

PROBLEM PRESENTATION AND BACKGROUND OF THE INVENTION

In roll stands, herein also designated roll changing devices, a continuous unrolling of an earlier reeled web of for instance newsprint, paperboard etc. is done to some type of converting machine for treatment of said web, for instance, a printing machine for production of printed matter, magazines etc. or, for instance, a folding machine or cutting machine for production of miscellaneous other paper products. Roll stands of the type specified above are known in different designs. It is typical that also the competitive alternatives generally are constructed with the same technical properties and capabilities. Consequently, the price is an important and growing factor for the customer.

It is therefore a desire to manufacture a roll stand that comprises the most essential properties that are requested for the known roll stands of today, but to a substantially lower production cost per produced unit.

All roll stands for continuous unrolling of a web, always comprise at least two roll holders, each for at least one roll of the web-like material in question. For instance, the roll holders consist of two or several pairs of roll holding arms, which are arranged at and around a mutual, turning axis in the roll stand. The material rolls can of course consist of other materials than paper, for instance plastic or foil, but however, they normally consist of paper rolls from which a running paper web is consequentially unrolled without breakage to the current converting machine. This is done by splicing the roll, which is being used up, to a new replacement roll by a so-called "flying splice", which replacement roll is held in preparedness in one of the other pairs of roll holding arms. The implication of the phrase "flying splice" is that the splicing is usually done without reducing the web feeding speed, or at least that it is substantially maintained during the actual joining. Thereby it is achieved that no unwanted breakage of the current production of, for instance, printed matter, magazines etc. occurs. It is understood that it is utmost important that the two different webs are spliced to each other with a great precision, in particular as the webs already may be provided with print for production of different printed matter and ontop of which first print, another and additional second print is to be applied at exact locations, for instance in connection with writing addresses on therefore arranged address tags on printed matter.

One of the essential properties mentioned above, which a well-working roll stand must be able to handle, is that the roll holding arms of the roll stand must be able to perform four different types of adjustments in a simple and effective manner, simultaneously as the precision still becomes very exact for all these adjustments.

These are, for the first, a roll holder positioning, i.e. the mutual adjustment of the lateral position of each roll holding pair which must be done, in which each pair is to be seen as one unit, along the hub girder of the roll stand, i.e. the central hub girder, around which the first roll, which is rotatably held during unrolling, the or those, second, third etc., roll or rolls, which are intended for web splicing, are turned. When the rolls have the same width, said position is normally the same for all the arm pairs. (In this description, the unit mentioned above is designated "roll holder".)

Secondly, a roll width adjustment, i.e. the adjustment of the relative positions of the roll holding arms to the size of the current roll type, which for the time being is to be handled in the roll stand, for instance, depending on if the roll consists of a half roll or a full roll.

Thirdly, the chucking movement, which is performed in order to get one gripper at each roll holding arm in each pair of roll holding arms to be, in an alternating mode, released out of, and thereafter re-inserted into, the sleeve of the roll in connection with each roll change between an emptied roll to a new full roll, and which is normally done during ongoing unrolling at another pair of roll holding arms.

And finally, a fourth and relatively modest movement for a precision adjustment of the lateral position of a roll in relation to another roll in conjunction with web splicing and/or for an exact positioning of the material web to a desired web direction during the present unrolling.

Known Technique

According to conventional engineering, at least two separate motor-driven units are used in order to achieve the two first movements and the two later ones. The roll holder positioning and the adjustment of the reel width are done by means of a first separate drive unit which enables a movement of the roll holding arms in each pair of roll holding arms along the hub girder, both together as one unit in connection with the roll holder positioning and alone in connection with the adjustment of the reel width, while an additional drive unit provides a movement of each chuck for the chucking movement in connection with the roll change and for the precise adjusting movement at roll changing and/or during the current operation. This is a very expensive and complicated solution, which, in addition to this, brings along certain control-engineering problems, since two movements must be superposed on each other. Therefore, an advanced control unit is needed, for instance comprising a computing unit.

Through the development of the roll stand which is partly described in the document WO 99/46518, came a roll stand out on the market for the first time, in which all the movements (1–4) mentioned above are being handled of one and the same motor/drive unit arranged at each pair of roll holding arms. This roll stand is constructed in order to allow the largest imaginable flexibility, so that almost all kinds of different roll sizes can be driven without being locked to some few given positions for each roll holder arm. This has shown to be a very appreciated solution, but it is expensive, among other things because of the fact that the machine demands a very expensive analogous adjusting device with a high resolution (AIHU) and an enhanced and expensive adjusting device in the form of a very long high precision ball screw (HPKS).

OBJECT OF THE INVENTION AND ITS CHARACTERISTICS

The object with the present invention is to achieve a roll stand, which is maintaining the most essential properties a well-functioning roll stand should be able to handle, but to a so low cost as possible, for instance the most essential advantages according to the principles given for the roll stand that is mentioned in WO 99/46518, but without the expensive "AIHU" and "HPKS" of said roll stand.

The roll stand according to the invention is characterised in that the roll stand also comprises a positioning arrangement for an adjustment of the position of each roll holder laterally along the hub girder and for a mutual adjustment of each of the roll holding arms in each such roll holder after the width of the current roll in the roll holder, an adjustment device at each roll holding arm for releasing of the grippers from a depleted roll and then for re-gripping of a new full roll in connection with roll changing and for a lateral precision adjustment of the position of one roll in relation to another roll and/or for a positioning of the material web to a desired web direction during the present unrolling.

According to additional aspects for roll stands according to the invention it applies:

that the positioning arrangement comprises a linear guiding unit arranged at each roll holding arm for a displaceable co-operation along one or several of the tracks, a locking unit for a releasable and firm locking of the roll holding arm at a desired position along said tracks and a reference device for the indication of that said desired position have been reached.

that the linear guiding unit comprises bearing jaws which are firmly mounted at the end surface of the roll holding arm towards the hub girder and by which bearing jaws the roll holding arm is displaceable along at least one of the tracks which are firmly mounted along the hub girder.

that the lock unit is linearly journalled along one of the tracks and that it comprises a spring-loaded locking mechanism with locking elements, which is moveably arranged between a first active mode in which the track is gripped and a second de-activated mode in which the locking elements are loosened from the track and a device for loosening of the engagement of said locking element from the track, before and during a displacement of the roll holding arm in question.

that the device consists of a pneumatic or hydraulic device comprising a connection nipple for supplying of pressure fluid for loosening of said engagement of said locking element with the track before and during a displacement of the roll holding arm in question.

that the device consists of a mechanical or electromagnetic device for the freeing of said locking element from the track before and during a displacement of the roll holding arm in question.

that the reference device comprises a scale unit, which is rigidly mounted along the hub girder, and a pointer, which is moveable in relation to the scale unit and which follows the movements of the roll holding arm or the locking unit.

that the adjustment device at each roll holding arm comprises a drive unit for moving of the roll holding arm after its locking by means of the locking unit to the track, which drive unit comprises a motor, which is arranged to actuate a ball screw that is rotatably arranged in a bearing support and which bearing support is rigidly mounted at the roll holding arm at its end surface, which ball screw extends along and parallel to the track for co-operation with a ball nut, which is attached to the locking unit for achieving of the movements of the roll holding arm between two end positions.

that the adjustment device comprises a sensor unit for detection of whether the gripper is in engagement with or declutched from the roll and which sensor unit comprises one or several sensors, for instance induction sensors or photocells, which sense the locking unit.

that a motor is arranged at each roll holding arm for driving of the roll from standstill to the same peripheral velocity as the currant web velocity of the material web that is being unrolled.

that a brake device of a conventional type is arranged at least at one roll holding arm for adjusting of the web tension and speed of the web being unrolled.

that the roll stand comprises more than two roll holders, which are mounted at the hub girder on a preferably mutual distance that is determined by the number of associated roll holders around the hub girder.

SOME ADVANTAGES OF THE INVENTION

By not using the long, advanced and expensive high precision ball screw (HPKS) for moving the roll holding arms between different positions along the hub girder in connection with the above described roll holder positioning and roll width adjustment and by using a simple locking mechanism instead, which the machine operator loosens in conjunction with any movements and then locks again when the correct position have been reached, the movement may, if so is desired, easily be made manually since the roll holding arms are journalled along linear guidings, which results in a very small resistance.

The fact that each chuck is fixed in relation to the roll holding arm it is arranged to, i.e. the fact that the roll holding arms instead are transferred in relation to each other at chucking movements along the hub girder, constitutes, in comparison with conventional technique in which the chuck is accordingly arranged in a moveable way in relation to the roll holding arm, an advantageous design principle considering the costs. In conjunction with precise adjustment movements during operation, the entire arms are consequently transferred as well.

LIST OF FIGURES

The invention will be closer described in the following with reference to the annexed figures in which:

FIG. 1A is a schematic front view of parts of a roll stand according to the present invention, which roll stand comprises four roll holding arms, which are arranged in pairs for handling one roll of web-like material in each pair and which roll holding arms are mounted linearly displaceable, in pairs as well as alone, laterally along a hub girder and around which the material rolls are arranged to be turned.

DETAILED DESCRIPTION OF THE DESIGN

Figure 1B:
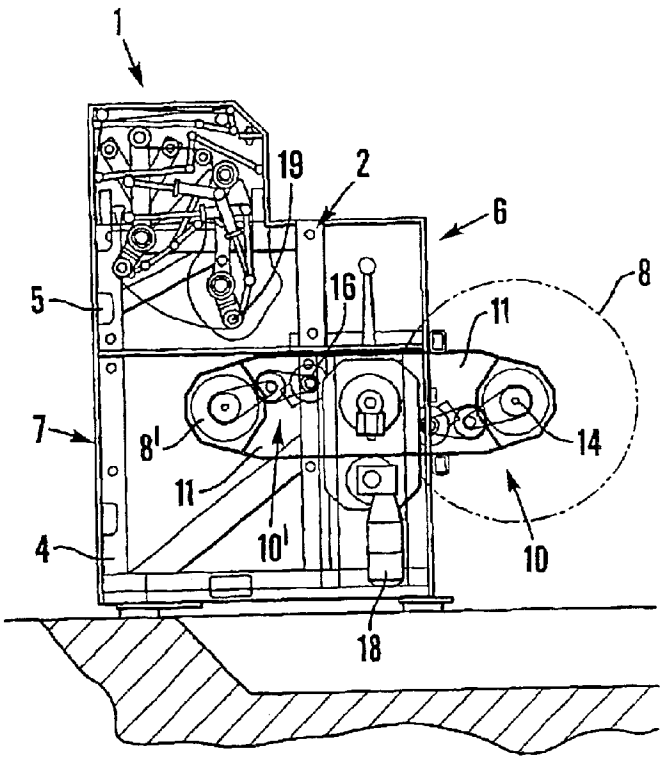
FIG. 1B is a schematic side view of parts of the roll stand according to FIG. 1A.
Figure 1A:
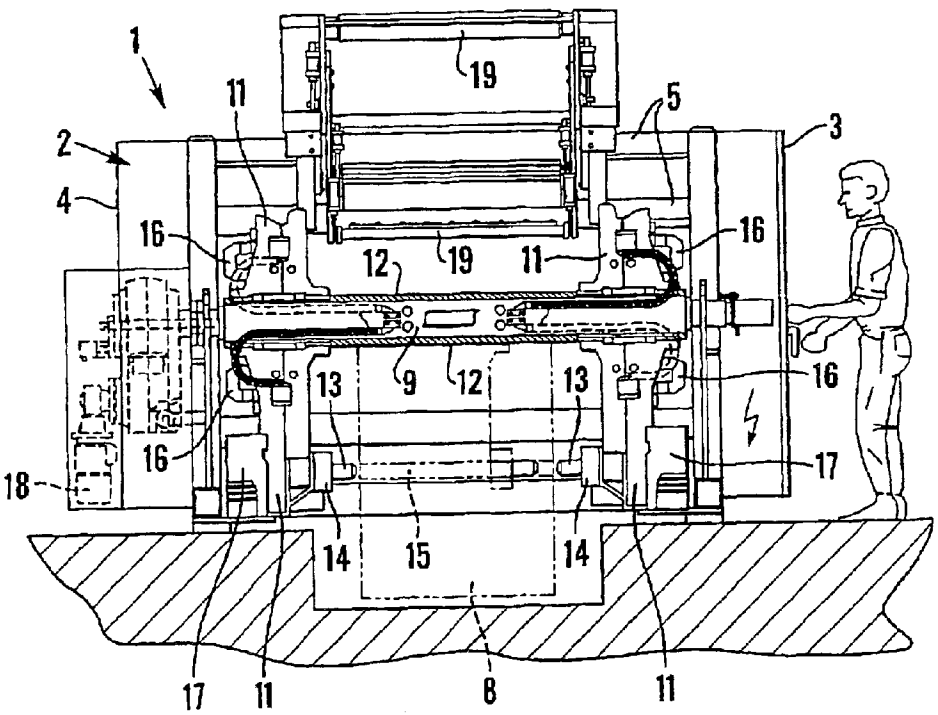
Figure 2:
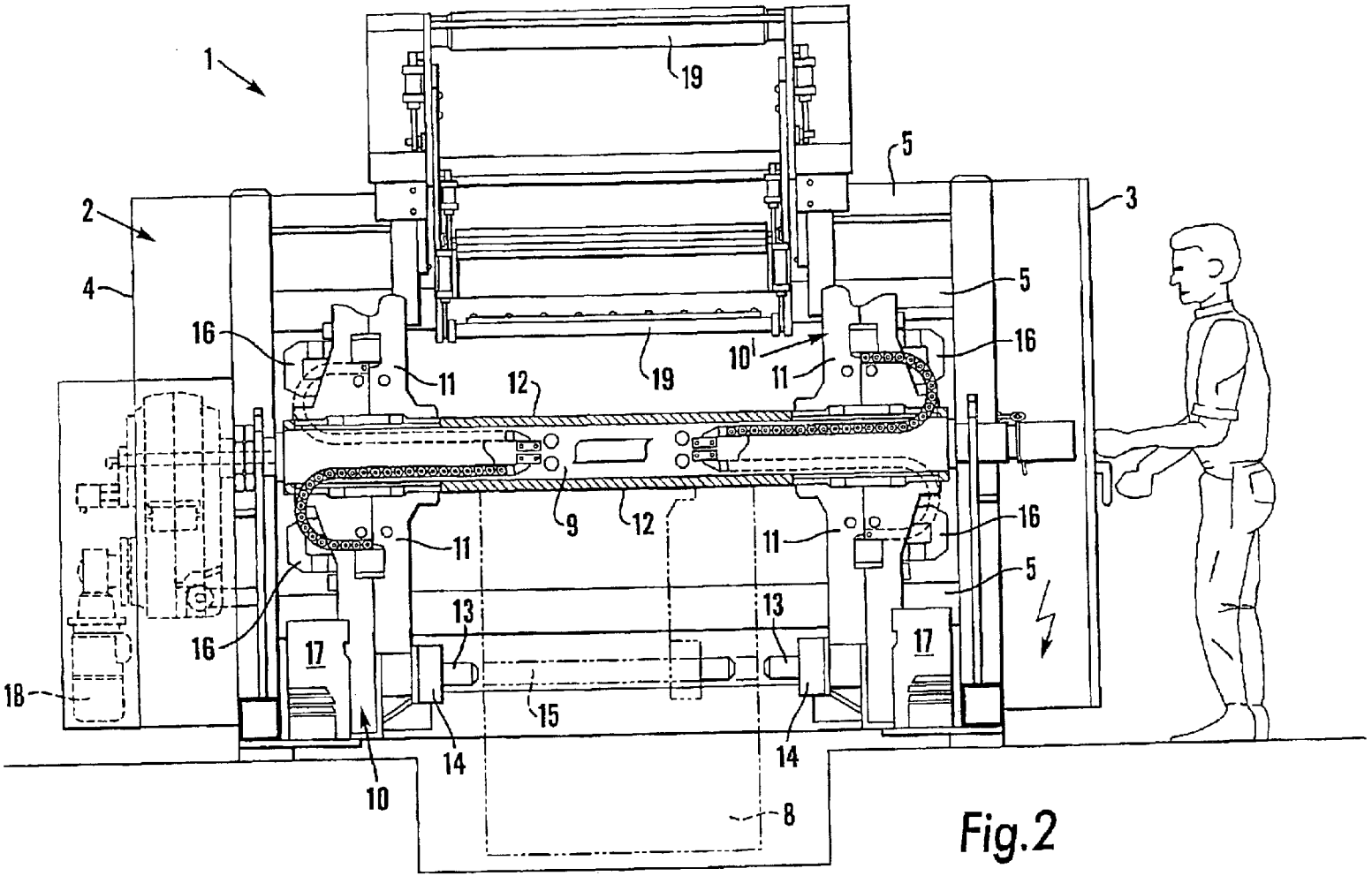
FIG. 2 is a schematic front view in a larger scale of the roll stand according to FIG. 1A, in which the four roll holding arms are shown more clearly.

With reference to FIG. 1A, FIG. 1B and FIG. 2, parts of a roll stand 1 according to one preferred embodiment of the present invention is schematically shown in front view, side view and in a larger scale, which roll stand 1 comprises a machine stand 2 with two gable sides 3, 4 which are arranged aloof from and incorporated with each other by means of several transverse beams 5. The machine stand 2 further comprises an inlet side 6 and an outlet side 7. New rolls 8 filled with web-like materials, preferably paper rolls, intended for unrolling in said roll stand 1 are delivered to the inlet side 6. Consequently, the outlet side 7 constitutes the side of the roll stand 1 from which the web-like material is unrolled for transfer to one or several succeeding machines intended for further converting the web material, not shown. For instance, one such typical converting machine consists of a rotary printing machine, which uses paper in web-like form and which is continuously reeled off from one paper roll after the other in a continuous roll changing from an almost depleted roll 8' to a new full roll 8 in a manner that is more closely described below.

The roll stand 1 comprises a horizontally arranged roll holding arm girder 9, which is journalled as a turnable axis between the gable sides 3, 4 at the inlet side 6 of the roll stand 1. Consequently, the roll holding arm girder 9, designated hub girder 9 below, constitutes the hub around which the rolls 8 are arranged to be turned between a current mounting position or assembly interval at the inlet side 6 for the new full roll 8 to a second, current unrolling position/interval for the same roll 8 at the outlet side 7.

In the embodiment which is especially shown in the figures, the roll stand 1 comprises two roll holders 10, 10', which are arranged on opposite sides of the hub girder 9, each for handling of a roll 8, 8' of web-like material. Each roll holder, 10, 10' comprises two elongated roll holding arms 11, which are mounted linearly displaceable, pair-wise as well as alone, in the lateral direction along one or several tracks 12, in this case two parallel rails 12, which are firmly mounted axially along the hub girder 9.

With pair-wise is here meant that the two pairs of roll holding arms 11 are arranged linearly displaceable together with a gripped roll as one unit and at the relative distance between the roll holding arms 11 that is needed to create said roll holder 10 and which distance is determined by the currently handled roll 8. With alone is here meant that the roll holding arms 11 are arranged linearly displaceable independently of each other along the tracks 12 of the hub girder 9 for a width adjustment of the roll.

In other, but not shown, embodiments of the roll stand according to the invention, this can naturally comprise more roll holders than for only two rolls, for instance three or four roll holders, which then are arranged in the same way at the hub girder, but in a relative, preferably the same, distance between the roll holders, which distance then is determined by the number of associated roll holders around the hub girder.

Each roll holding arm 10 extends out from the hub girder 9 in a substantial right angle and comprises a gripper 13 for a roll 8 at its outer free end part. The gripper 13 is journalled at the roll holding arm 10 by means of a rotatably axis 14. In the embodiment shown, the grippers 13 are constructed as chucks 13 intended to grip into the ends of cores 15, on which cores the material rolls 8 are rolled. Consequently, the rolls 8 are being rotatably held between the respective roll holding arms 10 and on said chucks 13. On each roll holding arm 10 is a motor 16 arranged for operation of the roll 8 from standstill to the same peripheral speed as the current web velocity of the material web, which is being unrolled. The motor 16 may also be used, if so is desired, for the continued drive until the next roll change. Furthermore, a brake device 17 of a conventional type is arranged at each roll holding arm 10 for the adjustment of the web tension and speed of the web that is being unrolled, which brake device 17 is arranged at the axis 14 but at the opposite end of the axis 14 in relation to the gripper 13.

The roll stand 1 also have a drive assembly 18 in order to turn or move the hub girder 9 around or to and fro between the mounting position/interval for the new roll 8 to the unrolling position/interval for the same roll 8 at the roll change. The roll stand 1 also comprises other arrangements, as pendulum rollers 19 for controlling and adjusting the web-tension in the paper web, guide and control means and sensors for guiding and controlling of the associated engines, brakes, the number of revolutions of the paper rolls, the web tension etc. (not shown), which arrangements however will not be closer described here.

Figure 3:
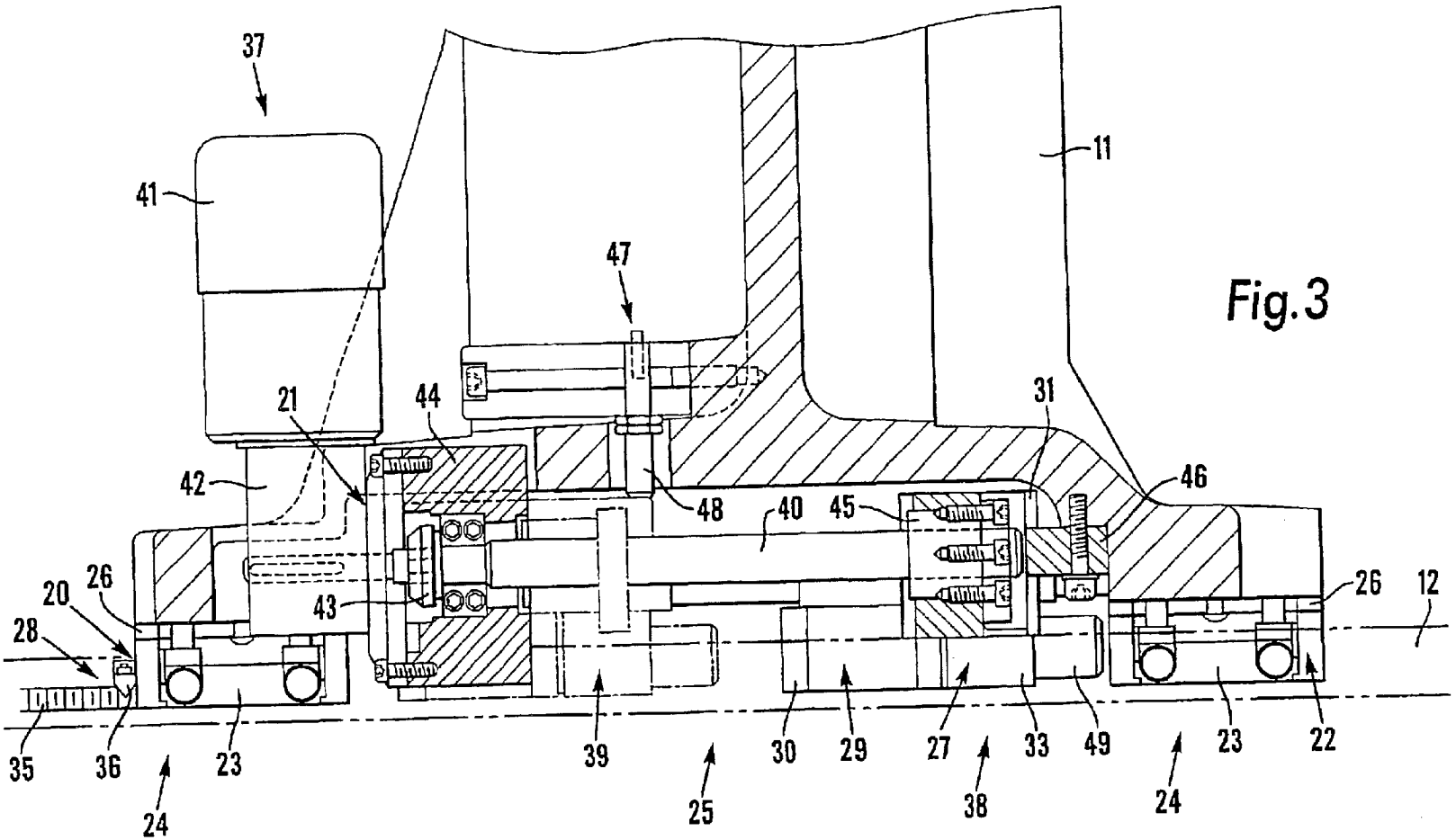
FIG. 3 shows schematically, and in a larger scale, a cross section of parts of one of the roll holding arms according to FIG. 1A in connection with the assembly of this to the hub girder.
Figure 4:
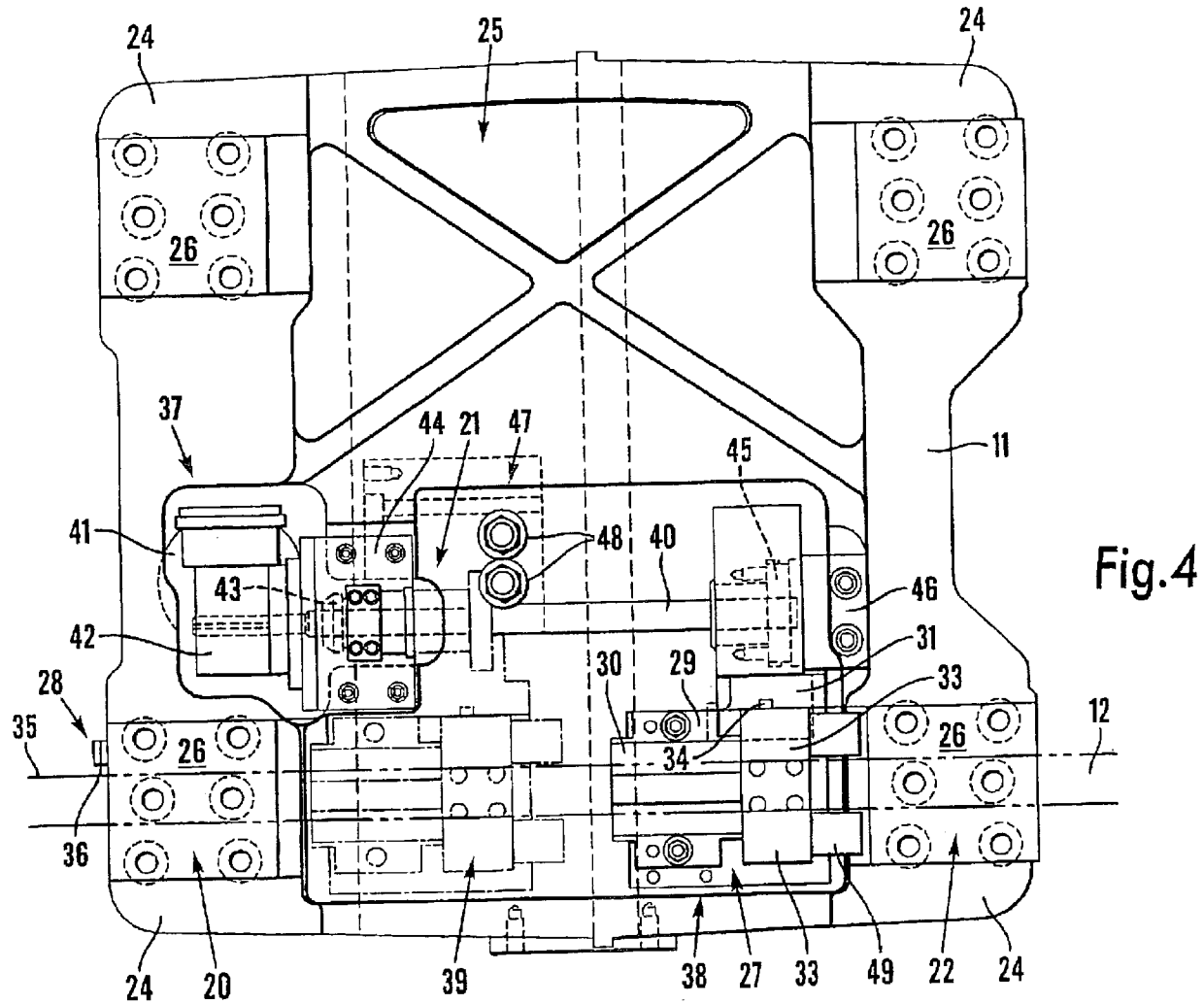
FIG. 4 shows schematically an end view of parts of the roll holding arm according to FIG. 3.

Further, the roll stand 1 comprises, see the FIGS. 3 and 4, a positioning arrangement 20 for the positioning of the roll holder, i.e. the adjustment of the position of the pair of roll holding arms 10 along the hub girder 9 and for the adjustment of the roll width, i.e. the relative adjustment of the roll holding arms 11 after the present roll width, and a motor-driven adjustment device 21 for performing chucking movements and finer adjustment movements.

The positioning arrangement 20 for each roll holding arm 11 comprises a linear guiding unit 22, which has movable parts which comprise four displaceable bearing jaws 23 and of which two are shown in FIG. 3, however, all of them are firmly mounted in a corner area 24 of their own on the end surface 25 of the roll holding arm toward the hub girder 9 by means of a bearing jaw attachment 26 for each of them for a pair-wise cooperation along one of the tracks 12 which are firmly attached along the hub girder 9, a locking unit 27 for a releasable but firm locking of the roll holding arm 11 at one desired position along the tracks 12 and a reference device 28 for indication that said desired position has been reached. The four mutually parallel tracks 12 are arranged in pairs at opposite sides of the hub girder 9, preferably along the entire extension of said girder 9.

The locking unit 27 comprises an assembly part 29, which is linearly journalled along one of the tracks 12 by means of a bearing jaw 30, a torque arm 31, which is arranged projecting from the assembly part 29, a spring loaded locking mechanism, not closer shown, with two locking elements 33, which are movably arranged on each side of the current track 12 between a first active position, which is gripping around the tracks 12 by means of said spring loading, and a second loosened, deactivated position, and a device 49 for the releasment of the engagement of said locking elements 33 from the track 12 before and during a displacement of the current roll holding arm 11. Said device 49 may consist of a mechanical or electro magnetic device, not shown, or preferably of a hydraulic or pneumatic device, which comprises a connection nipple 34, see FIG. 4, for supplying pressure fluid for the detachment of said locking elements 33 from the track 12 before and during a displacement of the current roll holding arm 11 sideways along the tracks 12 for providing the roll holder positioning and/or the adjustment of the real width.

The reference device 28 comprises a scale unit 35, which is firmly mounted along the hub girder 9, and a pointer 36 that is movable in relation to the scale unit 35 and which follows the roll holding arm 11, or the locking unit 27, in connection with its displacement, and which is suitably arranged at the outside of the roll holding arm 11 so that it is visible for the operator.

The motor driven adjustment device 21 for performing of the chucking movements and the fine adjustment movements of each roll holding arm 11 comprises a drive unit 37 for moving the roll holding arm 11, after locking this with the help of the locking unit 27 to the track 12 at a desired position along the hub girder 9, which is indicated by means of the pointer 36 and the scale unit 35. The drive unit 37 is arranged to move the roll holding arm 11 such a distance to and fro between two end positions 38, 39 along the hub girder 9, determined of the length of a ball screw 40 (closer described below), that the gripper 13 is entirely inserted into the core 15 of the reel 8 at the first end position 38 and fully loosened from the core 15 at the opposite, second end position 39 and which distance constitutes a movement of approximately ±150 mm for each roll holding arm 11. The drive unit 37 comprises a motor 41, which is arranged to operate said ball screw 40 by way of a worm gear 42. The ball screw 40 is pivotally arranged by means of a rotational suspension 43 in a bearing support 44 which is rigidly mounted at one side of the end surface 25 of the roll holding arm 11 and which ball screw 40 extends parallel along the track 12 towards the opposite side. The ball screw 40 is cooperating with a ball nut 5 that is attached in a torque arm 31 belonging to the locking unit 27 for achieving of the movement of the roll holding arm 11 between the two end positions 38, 39. A stop 46 is mounted at the free end of the ball screw 40 for locking of the movement of the torque arm 31 along the ball screw 40 in the direction from the bearing support 44.

The adjustment device 21 also comprises a sensor unit 47 for detection of whether the gripper 13 is in engagement with or declutched from the core 15 of the sleeve 8, which sensor unit 47 comprises one or several sensors 48, for instance induction sensors or photo cells, which sense the locking unit 27, for instance the presence or the absence of the torque arm 31 of the locking unit 27.

Description of the Function

The function and the use of the roll stand 1 according to the invention are as follows.

Before the start of the continuous unrolling, which the roll stand is intended to handle, the roll stand 1 must be loaded with at least one first roll 8 with reeled, web-like material, and from which first roll 8 the initial unrolling is commenced.

This first roll 8 is transported up to the roll stand 1 by a suitable, not shown device or vehicle, after which a first pair of roll holding arms 10 is turned by the drive motor 18 to a position close to the core 15 of the roll 8, which position is correct for a gripping of the roll 8. This correct position is set either in conjunction with transporting a first roll 8 of a new size to the roll stand 1 or, if the new roll width is known, by means of the reference device 28 in a manner more closely described below. The operator connects a conduit to the connection nipple 34 of the locking unit 27, arranged at one of the roll holding arms 11, and by doing so supplies a suitable pressure fluid to the spring-loaded locking mechanism in said locking unit 27. By the effect of the supplied pneumatic or hydraulic pressure, the spring force of the locking mechanism is neutralized, whereby the two locking elements 33 on each side of the track 12 are released from their frictional engagement with the track 12. The present roll holding arm 11 may now be displaced along the hub girder 9 to a position either adjacent the current side of the roll 8 or to a position that is indicated by the reference device 28. At the correct position, the pressure conduit is removed, after which the spring-loaded mechanism makes the locking elements 33 to provide a frictional engagement with the track 12. Thereafter the same thing is done again for the opposite roll holding arm 11 in the current pair of roll holding arms 10, after which a positioning of a roll holder and a roll width adjustment consequently have been accomplished for the first roll holder 10. Then the other roll holding arms 11 are also moved in a corresponding manner to their comparable positions. Since each roll holding arm 11 is arranged with a pointer 36 of its own, which is identically arranged in relation to the scale unit 35, it is simple to set the opposite placed roll holding arms 11, including the roll holding arms 11 in all the other pairs of roll holding arm 10', at an exact position by comparing with the pointer 36 of the first roll holding arm 11 that was pre-set.

These infinitely variable configurations, both laterally along the hub girder 9 to variable roll holder positions and to separate relative distances between the roll holding arms 11 for these roll holder positions, may easily be done manually while the linear bearings 22 of the roll holding arms 11, comprising the two tracks 12 and the bearing jaws 23, which are arranged in pairs and which are displaceable along these tracks 12, only have a very small frictional resistance.

After a completed roll holder positioning and a roll width adjustment, the operator now activates the motor-driven adjustment device 21 for achieving of a secure gripping of the present roll 8, which means that each adjustment device 21 at both roll holding arms 11 via its ball screws 40 moves the roll holding arms 11 inwards, i.e. towards each other, so that an in-chucking is achieved.

Thereby, each ball screw 40 is activated by means of the accompanying worm gear motor 41 through the worm gear 42 in a displacing movement which displaces the entire roll holding arm 11, which is done by the fact that the locking elements 33 firmly hold the assembly part 29 of the locking unit 27 in the set position at the track 12 so that the ball screw 40 pulls the bearing support 44 of the locking unit 27 closer to itself by means of the ball nut 45 that is fixed in the torque arm 31. The fact that a correct gripping position has been attained, is detected by the sensor unit 47 of each adjusting device 21 by means of a sensing of the presence of the torque arm 31 by its sensors 48. In a comparable way, the same sensor unit 47 is sensing, in connection with the loosening of one depleted roll 8', the absence of the torque arm 31, which indicates that both the grippers 13 of the roll holder 10 have been detached, that a new full roll 8 can be gripped again.

Then the roll stand 1, with its roll holding arms 11 positioned in the described manner, may be put into operation, wherein one after the other of the rolls 8 are turned from the mounting position or the assembly interval at the inlet side 6 to the other unrolling position/interval for the same roll 8 at the outlet side 7, where the rolls 8 then are consecutively unrolled by successively switching the emptied rolls 8' to full rolls 8 by means of the roll changing in the roll stand 1.

Alternative Embodiments

The invention is not limited to the specially described and shown embodiment; on the contrary, it can be varied in different ways within the frame of the claims. For instance, it is realized that, in accordance with the embodiment of the roll stand 1 shown in the figures, the positioning arrangement 20, which preferably is manually manoeuvred, also may be formed displaceable by means of one or several conventional drive means, which are especially intended for this but which are not shown. One such conventional drive assembly may for instance be comprised of a pneumatically or hydraulically actuated cylinder device or a motor-driven mechanical device of any suitable type, which is arranged to move the roll holder 10, 10' and the roll holding arms 11 along the linear guidings 22, 12 to a position along the hub girder 9 that is determined of the operator and/or to a position indicated by the reference device 28. What is here stated about the conventional drive means may also be valid for the motor-driven adjustment device, which then also can be constructed to function in an electromagnetic mode, however not shown.

The above mentioned pressure fluid for the locking mechanism is preferably pneumatic, but also a hydraulic fluid lies within the inventive thought.

The sensing unit 47 may also be arranged to detect more positions of the locking unit 27 then merely the presence or absence, in which the performed lateral precision adjustment may be indicated in more ways than by the help of the reference device 28. It will be understood that the number, the size, the material and the shape of the elements and details, which are associated with the roll stand 1, is adapted to the rolls which the roll stand is supposed to handle.

| Roll stand. | |
|---|---|
| 1. | Roll stand |
| 2. | Machine stand |
| 3. | Gable side |
| 4. | Gable side |
| 5. | Transverse beams |
| 6. | Inlet side |
| 7. | Outlet side |
| 8. | Roll |
| 9. | Hub girder |
| 10. | Roll holder |
| 11. | Roll holding arms |
| 12. | Tracks |
| 13. | Gripper |
| 14. | Axis |
| 15. | Cores |
| 16. | Motor |
| 17. | Brake device |
| 18. | Drive assembly |
| 19. | Pendulum rollers |
| 20. | Positioning arrangement |
| 21. | Motor driven adjustment device |
| 22. | Linear guiding unit |
| 23. | Bearing jaws |
| 24. | Corner area |
| 25. | End surface |
| 26. | Bearing jaw attachment |
| 27. | Locking unit |
| 28. | Reference device |
| 29. | Assembly part |
| 30. | Bearing jaw |
| 31. | Torque arm |
| 32. | Spring loaded locking mechanism |
| 33. | Locking element |
| 34. | Connection nipple |
| 35. | Scale unit |
| 36. | Pointers |
| 37. | Drive unit |
| 38. | End position |
| 39. | End position |
| 40. | Ball screw |
| 41. | Worm gear motor |

-continued

| Roll stand. | |
|---|---|
| 42. | Worm gear |
| 43. | Rotational suspension means |
| 44. | Bearing support |
| 45. | Ball nut |
| 46. | Stop |
| 47. | Sensor unit |
| 48. | Sensor |
| 49. | Device |
| 50. | |
| 51. | |
| 52. | |
| 53. | |
| 54. | |
| 55. | |
| 56. | |
| 57. | |
| 58. | |
| 59. | |
| 60. | |

What is claimed is:

1. A roll stand for continuously unrolling a plurality of rolls of reeled, web-like material, the rolls being unrolled consecutively after each other in the roll stand, and the rolls being arranged to be changed from an almost depleted roll to a new, full roll in the roll stand, wherein the roll stand comprises:

a machine stand comprising:

a pair of gable sides, each gable side being arranged separate from the other;

a hub girder arranged horizontally between the pair of gable sides, wherein the hub girder is rotatably journalled at the gable sides, and wherein the rolls are arranged around the hub girder to be pivoted between an inlet side to which each new, full roll is delivered, and an outlet side from which the web-like material is unrolled;

at least two roll holders arranged on opposite sides of the hub girder, wherein the at least two roll holders handle each roll and each roll holder comprises two roll holding arms mounted linearly displaceable in a lateral direction along at least one track, wherein each track is rigidly mounted axially along the hub girder, and wherein each roll holding arm is provided with a gripper to seize a roll;

a positioning arrangement to adjust a position of each roll holder laterally along the hub girder and for mutually adjusting each roll holding arm in each roll holder according to a width of the roll currently in the roll holder, wherein the positioning arrangement comprises:

a linear guiding unit arranged at each roll holding arm in a displaceable manner along the at least one track, a locking unit to release and firmly lock the roll holding arm at a desired position along the at least one track, and a reference device to indicate a desired position has been reached; and an adjustment device at each roll holding arm that releases the gripper from the depleted roll and seizes the new, full roll while changing rolls, and for a lateral precision adjustment of a position of one roll relative to another roll, and/or for positioning the material web in a desired web direction while unrolling the roll.

2. The roll stand according to claim 1, wherein a motor is arranged at each roll holding arm to drive the roll from a standstill position to a same peripheral velocity as a current web velocity of the material web being unrolled.

3. The roll stand according to claim 1, wherein the linear guiding unit comprises bearing jaws firmly mounted at an end surface of the roll holding arm, wherein the roll holding arm is displaceable by the bearing jaws along the at least one track, which is firmly mounted along the hub girder.

4. The roll stand according to claim 1, wherein the locking unit is linearly journalled along the at least one track and comprises:

a spring-loaded locking mechanism with locking elements that are moveably arranged between a first active mode wherein the at least one track is gripped and a second de-activated mode wherein the locking elements are loosened from the track; and a device that loosens the engagement of the locking elements from the at least one track before and during displacement of the roll holding arm.

5. The roll stand according to claim 4, wherein the device is a pneumatic or hydraulic device comprising a connection nipple to supply a pressure fluid for loosening engagement of the locking elements with the at least one track before and during displacement of the roll holding arm.

6. The roll stand according to claim 4, wherein the device is a mechanical or electromagnetic device that frees the locking elements from the at least one track before and during displacement of the roll holding arm.

7. The roll stand according to claim 1, wherein the reference device comprises:

a scale unit rigidly mounted along the hub girder; and a pointer moveable relative to the scale unit and which follows movements of the roll holding arm or the locking unit.

8. The roll stand according to claim 1, wherein the adjustment device comprises a drive unit that moves the roll holding arm after being locked by the locking unit to the at least one track, wherein the drive unit comprises a motor arranged to actuate a ball screw rotatably arranged in a bearing support, wherein the bearing support is rigidly mounted at an end surface of the roll holding arm, wherein the ball screw extends parallel along the at least one track for co-operation with a ball nut attached to the locking unit for moving the roll holding arm between two end positions.

9. The roll stand according to claim 1, wherein the adjustment device comprises a sensor unit that detects whether the gripper is in engagement with or declutched from the roll and which sensor unit comprises at least one sensor to sense the locking unit.

10. The roll stand according to claim 9, wherein the at least one sensor is one of an induction sensor or a photocell.

11. The roll stand according to claim 1, wherein a brake device is arranged on at least one roll holding arm to adjust a web tension and speed of the web being unrolled.

12. The roll stand according to claim 1, wherein the at least two roll holders are mounted on the opposite sides of the hub girder distance from each other that is determined by the number of associated roll holders around the hub girder.

* * * * *